US006991475B2

(12) United States Patent
Dreyer et al.

(10) Patent No.: US 6,991,475 B2
(45) Date of Patent: Jan. 31, 2006

(54) ELECTROTECHNICAL DEVICE

(75) Inventors: Volker Dreyer, Lörrach (DE); Wolfgang Brutschin, Schopfheim (DE); Gottfried Hintner, Schopfheim (DE)

(73) Assignee: Endress + Hauser GmbH + Co. KG, Maulburg (DE)

( * ) Notice: Subject to any disclaimer, the term of this patent is extended or adjusted under 35 U.S.C. 154(b) by 0 days.

(21) Appl. No.: 10/503,087

(22) PCT Filed: Jan. 24, 2003

(86) PCT No.: PCT/EP03/00712

§ 371 (c)(1),
(2), (4) Date: Jun. 16, 2005

(87) PCT Pub. No.: WO03/071636

PCT Pub. Date: Aug. 28, 2003

(65) Prior Publication Data

US 2005/0255733 A1 Nov. 17, 2005

(30) Foreign Application Priority Data

Feb. 23, 2002 (DE) ..... 102 07 762

(51) Int. Cl.
*H01R 12/00* (2006.01)

(52) U.S. Cl. ..... 439/76.1; 439/276; 439/936

(58) Field of Classification Search ..... 439/76.1, 439/276, 936, 913

See application file for complete search history.

(56) References Cited

U.S. PATENT DOCUMENTS

| | | | | |
|---|---|---|---|---|
| 4,335,932 | A * | 6/1982 | Herrmann, Jr. | 439/587 |
| 4,425,017 | A * | 1/1984 | Chan | 439/276 |
| 6,051,783 | A * | 4/2000 | Dreyer et al. | 174/52.2 |
| 6,854,996 | B2 * | 2/2005 | Yaworski et al. | 439/276 |
| 2001/0038883 | A1 | 11/2001 | Gass et al. | |

FOREIGN PATENT DOCUMENTS

| | | |
|---|---|---|
| DE | 38 18 499 C2 | 12/1989 |
| DE | 40 23 792 A1 | 1/1992 |
| DE | 195 04 608 C2 | 8/1996 |
| EP | 0 991 307 A2 | 4/2000 |
| EP | 1 076 479 A | 2/2001 |

* cited by examiner

*Primary Examiner*—Tho D. Ta
(74) *Attorney, Agent, or Firm*—Bacon & Thomas, PLLC

(57) ABSTRACT

An electrotechnical device is provided, having components connected by means of plug connections. The interior of the device is filled with a casting material. The device includes: a housing; arranged in the housing a first components which has at least one terminally-protruding contact pin; a second component which has a socket on which terminally-located contact plugs are provided for receiving the contact pins; and an insert in which the first component is arranged. The insert includes a secluded chamber which has an opening into which the socket of the second component is introduced. The chamber additionally includes a rear wall lying opposite the opening through which the contact pins are stuck into the contact plugs of the socket. An air-tight seal exists between the contact pins and the rear wall. The housing is filled with the casting material from an end lying opposite to the opening of the chamber.

5 Claims, 2 Drawing Sheets

ELECTROTECHNICAL DEVICE

FIELD OF THE INVENTION

The invention relates to an electrotechnical device with components linked with one another via plug-in connections.

BACKGROUND OF THE INVENTION

Modern electrotechnical devices, e.g. measuring devices, have, as a rule, a number of components. These components, e.g. sensors, electronics units, etc., are, in current times, preferably modularly constructed. A modular construction permits the device to be offered in a variety of different variants, without the necessity of having to stock all variants in sufficient quantities. Only the components, which can be combined as required, need to be stored. Moreover, a modular construction offers advantages during manufacture. Thus, a special variant of the device can be manufactured from the components in a very short time. Preferably, the components are connected together by simple plug connections.

Frequently, it is necessary to fill a remaining internal space of the finished device by casting a material thereinto, e.g. a silicone rubber, in order e.g. to prevent the penetration of moisture. To accomplish this, the casting material is filled into the device in the liquid state. Should the liquid material flow into the area of the electrical plug connections, the quality of an electrical connection between the contacts to be connected by the plug connection can be degraded, or even effectively destroyed, by the casting material.

SUMMARY OF THE INVENTION

It is an object of the invention to provide a new electrotechnical device having components connected by means of plug connections and an inner space filled with a casting material.

To this end, the invention resides in an electrotechnical device having

- a housing,
- arranged in the housing, a first component
  - which has at least one terminally protruding, contact pin,
- arranged in the housing, a second component,
  - which has a socket, on which terminally-located, contact plugs are provided for receiving the contact pins,
- arranged in the housing, an insert,
  - in which the first component is arranged,
  - which has a secluded chamber,
    - which has an opening, into which the socket of the component is introduced, and
    - which has a rear wall lying opposite the opening, through which the contact pins are stuck into the contact plug of the socket,
- wherein an air-tight seal exists between the contact pins and the rear wall, and
- wherein the housing is filled with a casting material from an end lying opposite to the opening of the chamber.

In an embodiment, the first component is an electronics unit.

In an embodiment, the second component is a sensor unit.

In a further development, the chamber is a two-component injection molded part, which is made of a plastic of low Shore hardness at the locations where the contact pins pass through the rear wall.

In a further development, the rear wall of the chamber is self-sealing at the locations where the contact pins pass through the plastic of low Shore hardness.

Additionally, the invention resides in a method for the filling of an electrotechnical device of the invention with a casting material, wherein

- the device is set in an upright position, in which the opening of the chamber is down and the rear wall of the chamber is up, and
- the casting material is introduced from above,
- so that a plug connection existing in the interior of the chamber between the contact pins and the contact plugs is shielded by the chamber and a region of the plug connection remains free of the casting material.

BRIEF DESCRIPTION OF THE DRAWINGS

The invention and additional advantages will now be explained in greater detail on the basis of the figures of the drawing, in which an example of an embodiment is presented; equal elements are provided in the figures with equal reference characters.

DETAILED DESCRIPTION OF THE PREFERRED EMBODIMENTS

Figure 1:
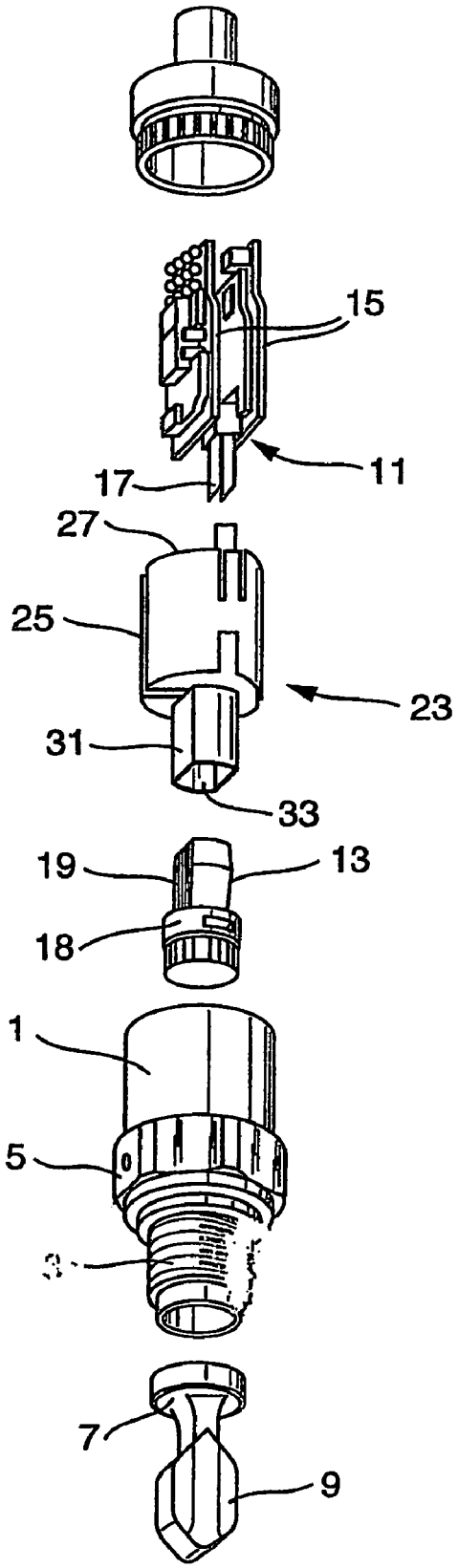
FIG. 1 shows an exploded view of an electrotechnical device.

FIG. 1 shows an exploded view of an electrotechnical deice of the invention.

In the illustrated example of an embodiment, the device is an electromechanical fill level sensor for determining and/or monitoring a predetermined fill level in a container. Such sensors are used in the measurement and control technologies.

The device includes a housing 1. The housing 1 is constructed as a screw-in piece with a threaded section 3 and a hexagonal head 5.

A cylindrical internal space of the housing 1 is hollow and closed at a lower end by a membrane, or diaphragm, 7. Formed on membrane 7 are ends of two oscillation rods 9. By means of the screw-in piece, the fill level sensor is so secured in an internally threaded opening of a container wall that the oscillation rods extend into the interior of the container and come into contact with a fill substance located in the container, when the fill substance reaches the predetermined fill level.

Located in the internal space are a first component 11 and a second component 13 of the electrotechnical device. The first component 11 is an electronic unit in the illustrated example of an embodiment. It is composed essentially of an electronic circuit arranged on two circuit boards 15. The first component 11 has at least one terminally-located, protruding contact pin 17. In the illustrated example, a plurality of contact pins 17 are arranged in two rows.

The second component 13 is e.g. a sensor unit. In the illustrated example, the sensor unit includes an electromechanical transducer. This is composed e.g. of piezoelectric elements arranged in a stack. The electromechanical transducer contains an exciting transducer and a receiving transducer. When an alternating voltage is applied to the exciting transducer, it causes the membrane 7 to oscillate. The oscillations are, in turn, transferred to the oscillation rods 9, so that these execute oscillations perpendicularly to their longitudinal axes. When mechanical oscillations act on the receiving transducer, these produce an electrical alternating voltage with the frequency of the oscillation.

The electronic unit contains an amplifier, which receives at the input the alternating voltage produced by the receiving transducer and transmits at the output the amplified alternating voltage to the exciting transducer. Consequently, the mechanical oscillation system formed by the membrane 7 and the oscillation rods 9 lies, via the electromechanical transducers, in the feedback loop of the amplifier, so that it excites itself to oscillations of an eigenresonance frequency. When the oscillation rods are not in contact with the fill substance, the eigenfreqency of the mechanical oscillation system is higher than when the oscillation rods immerse in the fill substance. The electronic unit assigned to the sensor unit contains an additional, evaluating circuit, which determines, whether the frequency of the alternating voltage issued by the amplifier lies above or below a predetermined threshold value. If the frequency is above the threshold value, then the oscillation rods 9 are oscillating freely; if it is beneath, then the oscillation rods 9 are covered by fill substance.

The first and second components 11, 13 are both arranged in the housing 1. The second component 13 includes a base element 18 and a socket 19 formed thereon. The second component 13 includes a base element 18 and a socket 19 formed thereon. On the socket 19 are terminally-located contact plugs 21, which are provided to receive the contact pins 17.

Figure 2:
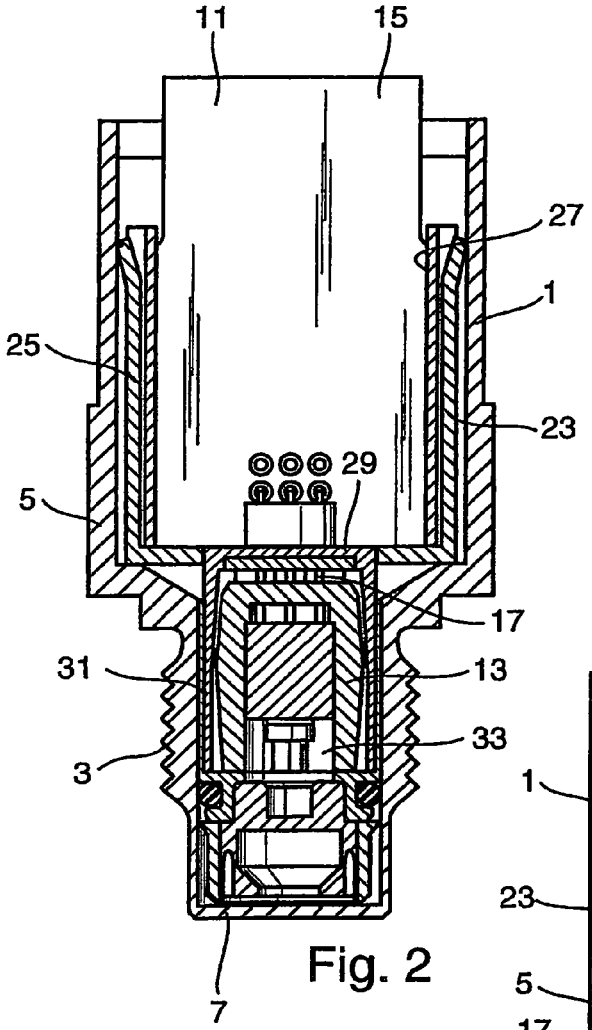
FIG. 2 shows a section through the housing with two components connected by a plug connection.
Figure 3:
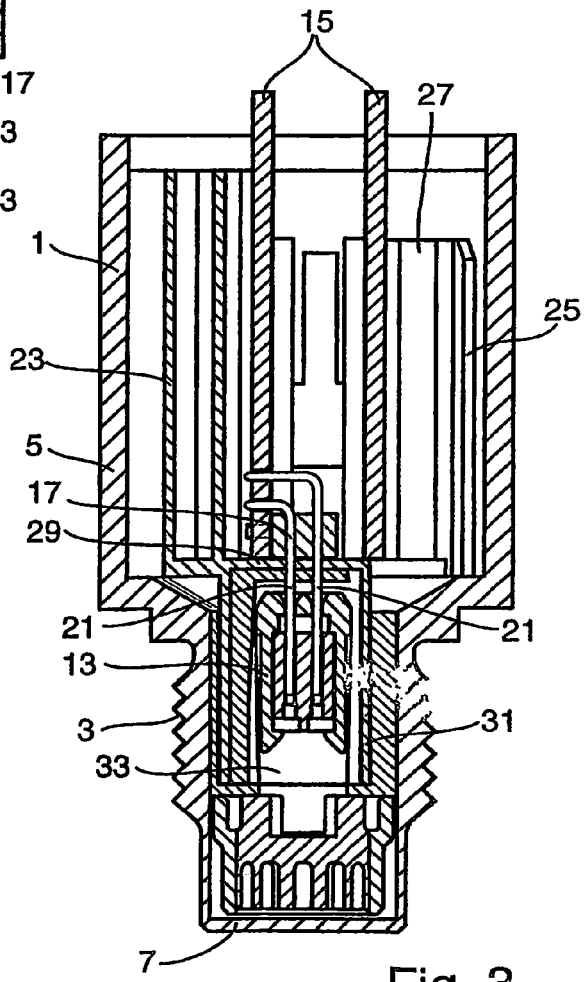
FIG. 3 shows a section through the housing with the two components, with the cutting plane rotated 90° with respect to the cutting plane used for FIG. 2.

FIGS. 2 and 3 show two sections through the device of FIG. 1. For clarity, the oscillation rods 9 are not shown in FIGS. 2 and 3.

The sections of FIGS. 2 and 3 are in cutting planes which are rotated 90° with respect to one another.

Housing 1 also contains an insert 23, which serves to receive the first component 11. In the illustrated embodiment, insert 23 has an essentially cylindrical section 25, into which the electronics unit is introduced, through a terminal, first opening 27. A holder is provided in the cylindrical section 25 for the circuit boards 15.

The cylindrical section 25 is closed by a rear wall 29 at its end lying opposite to the opening 27.

On the cylindrical section 25, on a side of the rear wall 29 facing away from the opening 27, a secluded chamber 31 is formed. When the first unit 11 is introduced into the insert 23, the contact pins 17 pierce the rear wall 29 and protrude into the chamber 31. An air-tight seal is formed between the contact pins 17 and the rear wall 29.

The chamber 31 forms preferably a two-component injection molded part, which is made of a plastic of low Shore hardness at the locations where the contact pins 17 pass through the rear wall 29. Of course, the chamber can be an integral part of the insert 23, which then preferably is constructed completely as a two-component injection molded part.

Preferably, in this two-component injection molded part, the rear wall 29 of the chamber 31 is constructed of a plastic of low Shore hardness at the locations where the contact pins 17 pass through. Such a soft plastic surrounds the contact pins 17 tightly and is therefore self-sealing in the area of the contact pins 17. This offers the advantage that no extra measures are necessary for achieving an air-tight sealing. Alone the sticking of the contact pins 17 through the rear wall effects the sealing.

The insert 23 is made e.g. of polycarbonate (PC) and suitable as soft plastic is e.g. a thermoplastic polymer. In selecting the synthetic material for the insert 23, one is relatively free. The choice of the soft plastic is, however, limited to materials assuring an air-tight self-sealing where the contact pins 17 pass through.

The chamber 31 has, located opposite the rear wall 29, an opening 33, into which the socket 19 of the second component 13 is introduced. At the same time, the contact pins 17 are stuck through the rear wall 29 lying opposite to the opening 33 and into the contact plugs 21 of the socket 19.

The housing 1 is filled with a casting material from an end lying opposite to the opening 33 of the chamber 31. The casting material is indicated in the figures by cross-hatching of horizontal, dashed lines.

Suitable as casting material is e.g. a gel-like two-component silicone rubber, which is liquid after the mixing of the two components and then vulcanized by addition cross-linking.

The device is filled with casting material by placing the device in an upright position. In this procedure, the opening 33 of the chamber 31 is down and the rear wall 29 of the chamber 31 up.

The casting material is filled in this position from above into the housing 1. The designations up and down refer to the filling positions shown in the drawings.

The casting material flows into the housing and moves through the opening 27 into the insert 23. This leads to the cylindrical region 25 becoming completely filled with casting material. Additionally, casting material flows outside, around the insert 23, and reaches in this way to the base element 18 of the second component 13. To the extent that the base element 18 has openings therefor, also interior spaces of the base element 18 can become filled with casting material.

The casting material fills the entire interior space of the device slowly, from below upwards, and seals the chamber 31 as it rises.

In contrast, no casting material can get into the chamber 31. During filling of the casting material from above, the chamber 31 forms a protective shell, on which the casting material flows externally downwards.

No casting material can go through the opening 33, because the trapped air resists such. Same as in the case of a cup, which is immersed into water with the opening down, the pressure of the trapped air also here prevents the penetration of liquid. A sealing of the opening 33 is not required.

The electrical plug connection existing inside chamber 31 between the contact pins 17 and the contact plugs 21 is shielded by the chamber 31. The region of the plug connection thus remains free of the casting material.

Of course, the device can also have two or more plug connections between individual components, which are kept free of casting material in the manner of the invention. For this, it is merely necessary to arrange the orientations of the individual chambers such that their rear walls point in the same direction.

What is claimed is:

1. Electrotechnical device, comprising:

a housing;

a first component in said housing which has at least one terminally protruding contact pin;

a second component in said housing which has a socket on which terminally-located contact plugs are provided for receiving the contact pins; and an insert in said housing in which said first component is arranged, which has a secluded chamber, an opening into which said socket of said second component is introduced, and a rear wall lying opposite said opening, through which the contact pins are stuck into the contact plugs of said socket, wherein:

an air-tight seal exists between the contact pins and said rear wall, and said housing is filled with a casting material from an end lying opposite to said opening of said chamber.

2. The device as claimed in claim 1, wherein:

said first component is an electronics unit.

3. The device as claimed in claim 1, wherein:

said second component is a sensor unit.

4. The device as claimed in claim 1, wherein:

said chamber is a two-component injection molded part which is made of a plastic of low Shore hardness at the locations where the contact pins pass through said rear wall.

5. The device as claimed in claim 4, wherein:

said rear wall of said chamber is self-sealing at the locations where the contact pins pass through the plastic of low Shore hardness.

* * * * *